US008523635B2

(12) United States Patent
Manuel et al.

(10) Patent No.: US 8,523,635 B2
(45) Date of Patent: Sep. 3, 2013

(54) TIRE BUFFING DEBRIS COLLECTING SYSTEM

(75) Inventors: Stephen Manuel, Flat Rock, NC (US); Robert Young, Simpsonville, SC (US); William E. Cheek, Jr., Taylors, SC (US)

(73) Assignee: Michelin Recherche et Technique S.A., Granges-Paccot (CH)

( * ) Notice: Subject to any disclaimer, the term of this patent is extended or adjusted under 35 U.S.C. 154(b) by 889 days.

(21) Appl. No.: 12/666,642

(22) PCT Filed: Jun. 29, 2007

(86) PCT No.: PCT/US2007/072500

§ 371 (c)(1),
(2), (4) Date: Dec. 23, 2009

(87) PCT Pub. No.: WO2009/005520

PCT Pub. Date: Jan. 8, 2009

(65) Prior Publication Data

US 2010/0319732 A1 Dec. 23, 2010

(51) Int. Cl.
*B24B 1/00* (2006.01)
*B24B 9/06* (2006.01)
*B24B 55/06* (2006.01)

(52) U.S. Cl.
USPC ..... 451/49; 241/DIG. 31; 451/58; 451/65; 451/195; 451/456

(58) Field of Classification Search
USPC ..... 15/347, 349; 241/DIG. 31; 451/49, 451/58, 65, 66, 178, 194, 195, 451, 456
See application file for complete search history.

(56) References Cited

U.S. PATENT DOCUMENTS 3,553,903 A 1/1971 Christie
3,574,973 A 4/1971 Rader (Continued)

FOREIGN PATENT DOCUMENTS

EP 1 189 014 A2 3/2002
EP 1 946 914 A1 7/2008

(Continued)

OTHER PUBLICATIONS

JP 2006-192795 A—English abstract obtained from Espacenet (http://worldwide.espacenet.com) accessed on Feb. 3, 2012, 1 page.

(Continued)

*Primary Examiner* — Timothy V Eley
(74) *Attorney, Agent, or Firm* — Hahn Loeser & Parks LLP; Bret A. Hrivnak, Esq.

(57) ABSTRACT

Improved apparatus and methods for collecting debris generated during a tire buffing operation on a tire buffing machine, the tire buffing machine having a cutting head cutting surface rotatable about a cutting head axis. The system includes a rotatable shroud being rotatable about a shroud axis, the shroud comprising a side member surrounding a majority of the cutting head cutting surface, a cutting head access window to expose the cutting head for buffing the tire casing, and a vacuum suction port that is adjacent to the cutting head access window. The system may further include a driver to rotate the shroud during buffing, wherein rotating the shroud during buffing aligns the vacuum suction port with the projected path of debris being discharged from the cutting head cutting surface.

22 Claims, 8 Drawing Sheets

(56) References Cited

U.S. PATENT DOCUMENTS

| | | | | |
|---|---|---|---|---|
| 3,633,279 | A | 1/1972 | Frazier et al. | |
| 3,675,706 | A | 7/1972 | Cahill | |
| 3,724,137 | A | 4/1973 | Hofelt, Jr. et al. | |
| 3,941,178 | A | 3/1976 | Simpson et al. | |
| 4,062,716 | A | 12/1977 | Galantine et al. | |
| 4,084,350 | A | 4/1978 | Ongaro | |
| 4,126,171 | A | 11/1978 | Sorenson | |
| 4,736,546 | A | 4/1988 | Ugo | |
| 4,914,869 | A | 4/1990 | Bayonnet et al. | |
| 5,005,628 | A | 4/1991 | Kinuhata et al. | |
| 5,022,186 | A | 6/1991 | Rogers, Jr. | |
| 5,067,539 | A | 11/1991 | Kinuhata et al. | |
| 5,103,595 | A | 4/1992 | Dale et al. | |
| 5,167,215 | A * | 12/1992 | Harding, Jr. | 125/13.01 |
| 5,216,372 | A | 6/1993 | Zoughi et al. | |
| 5,238,041 | A | 8/1993 | Tomita et al. | |
| 5,279,076 | A * | 1/1994 | Healy et al. | 451/456 |
| 5,307,854 | A | 5/1994 | Brewer | |
| 5,386,665 | A * | 2/1995 | Heim | 451/5 |
| 5,941,338 | A | 8/1999 | Miller et al. | |
| 6,005,397 | A | 12/1999 | Zoughi et al. | |
| 6,086,452 | A | 7/2000 | Lipczynski et al. | |
| 6,092,295 | A | 7/2000 | Parrish | |
| 6,251,204 | B1 | 6/2001 | Andersson et al. | |
| 6,386,024 | B1 | 5/2002 | Marck et al. | |
| 6,386,945 | B1 | 5/2002 | Fahringer et al. | |
| 6,405,146 | B1 | 6/2002 | Engel | |
| 6,470,778 | B1 * | 10/2002 | Kaye et al. | 83/100 |
| 6,745,809 | B1 | 6/2004 | Mory et al. | |
| 6,773,334 | B1 | 8/2004 | Mallison | |
| 6,877,502 | B2 * | 4/2005 | Register | 125/13.01 |
| 7,040,371 | B2 | 5/2006 | Mory et al. | |
| 2002/0088527 | A1 | 7/2002 | Tanaka et al. | |
| 2002/0106252 | A1 | 8/2002 | Tsuzuki et al. | |
| 2002/0170652 | A1 | 11/2002 | Parrish et al. | |
| 2003/0220060 | A1 * | 11/2003 | Bures et al. | 451/456 |
| 2004/0073339 | A1 | 4/2004 | Ruoppolo | |
| 2004/0200579 | A1 | 10/2004 | Mory et al. | |
| 2007/0004319 | A1 | 1/2007 | Poling, Sr. et al. | |
| 2010/0261412 | A1 | 10/2010 | Manuel et al. | |

FOREIGN PATENT DOCUMENTS

| | | | |
|---|---|---|---|
| JP | 2003-510188 | A | 3/2003 |
| JP | 2006-192795 | A | 7/2006 |
| WO | 01/23136 | A1 | 4/2001 |
| WO | 2005/014267 | A1 | 2/2005 |
| WO | 2007/029501 | A1 | 3/2007 |

OTHER PUBLICATIONS

PCT/US2007/065522 International Search Report and Written Opinion, Form PCT/ISA1237 dated Jul. 24, 2008.

PCT/US2007/065522 International Search Report, Form PCT/ISA/210 dated Jul. 24, 2008.

PCT/US2007/072369 International Search Report, Form PCT/ISA/210/220 dated Dec. 5, 2007.

PCT/US2007/072369 International Written Opinion, Form PCT/ISA/237 dated Dec. 5, 2007.

PCT/US2007/072376 International Search Report, Form PCT/ISA/220 dated Dec. 12, 2007.

PCT/US2007/072376 Written Opinion, Form PCT/ISA/237 dated Dec. 12, 2007.

PCT/US2007/079954 International Search Report, Form PCT/ISA/220 dated Jul. 31, 2008.

PCT/US2007/079954 International Written Opinion, Form PCT/ISA/237 dated Jul. 31, 2008.

PCT/US2007/072500 International Search Report Form PCT/ISA/210.

PCT/US2007/072500 International Written Opinion Form PCT/ISA/237.

JP 2003-510188 A—English abstract obtained from Espacenet (http://worldwide.espacenet.com) accessed on Feb. 3, 2012, 1 page.

WO 20071029501 Al—English abstract obtained from Espacenet (http://worldwide.espacenet.conn) accessed on Feb. 3, 2012, 1 page.

* cited by examiner

TIRE BUFFING DEBRIS COLLECTING SYSTEM

This application is a National Stage application of PCT Application No. PCT/US2007/072500, filed Jun. 29, 2007, to which this application claims priority and the benefit of, the disclosure of which is also hereby incorporated by reference.

BACKGROUND OF THE INVENTION

1. Field of the Invention

This invention relates generally to tire retreading and more specifically, to buffing machines for buffing tread from a crown of a tire.

2. Description of the Prior Art

Tires are known to comprise a tread consisting of an outer layer of rubber-based mixtures, of greater or lesser thickness, in which are molded various grooves and tread patterns intended, inter alia, to improve the vehicle's grip relative to the ground.

In certain cases, it is necessary to machine or remove the outer surface of the tire, for example, the tire tread, for the purpose of preparing a worn tire for retreading. Typically, tire tread removal has been accomplished by various types of cutting devices, such as rasps, grinding wheels, and wire brushes. Another process used for tire tread removal is a cutting process that utilizes a cylindrical cutter called a "peeler."

During the tread removal process, it may be desirable to collect the debris removed from the tire. Material removed by the methods discussed above creates debris that is preferably collected for disposal. It is well known in the art to provide a collection removal system for this material; however, these prior art systems do not satisfactorily collect the debris. Therefore, there is a need to provide an improved system for collecting debris generated during a tread removal process.

SUMMARY OF THE INVENTION

Particular embodiments of the present invention include a debris collection system for collecting debris generated while buffing a tire casing on a tire buffing machine. The tire buffing machine includes a cutting head having a cutting surface that is rotatable about the cutting head axis. Particular embodiments of the system include a rotatable shroud being rotatable about a shroud axis, the shroud comprising a side member surrounding a majority of the cutting head cutting surface, a cutting head access window to expose the cutting head for buffing the tire casing, a vacuum suction port adjacent to the cutting head access window, and a shroud driver. The driver rotates the shroud during buffing, wherein rotating the shroud during buffing aligns the vacuum suction port with a projected path of debris discharged from the cutting head cutting surface.

Particular embodiments of the present invention further include methods for collecting debris generated while buffing a tire casing on a buffing machine. Such embodiments may include the steps of translating the cutting head across a tire to a subsequent location and rotating a shroud about a shroud axis to obtain an alignment of a vacuum suction port of the shroud with a projected path of debris discharged from the cutting head cutting surface. Particular embodiments are implemented with the shroud comprising a side member surrounding a majority of the cutting head cutting surface, a cutting access window to expose the cutting head cutting surface for buffing the tire casing, a vacuum suction port adjacent to the cutting access window and a shroud driver for rotating the shroud during buffing. Particular embodiments may further include the step of collecting the debris through the vacuum suction port.

Additional embodiments of the present invention include tire buffing machines having the debris collection systems described above.

The foregoing and other objects, features and advantages of the invention will be apparent from the following more detailed descriptions of particular embodiments of the invention, as illustrated in the accompanying drawing wherein like reference numbers represent like parts of the invention.

DETAILED DESCRIPTION OF PARTICULAR EMBODIMENTS

Figure 1:
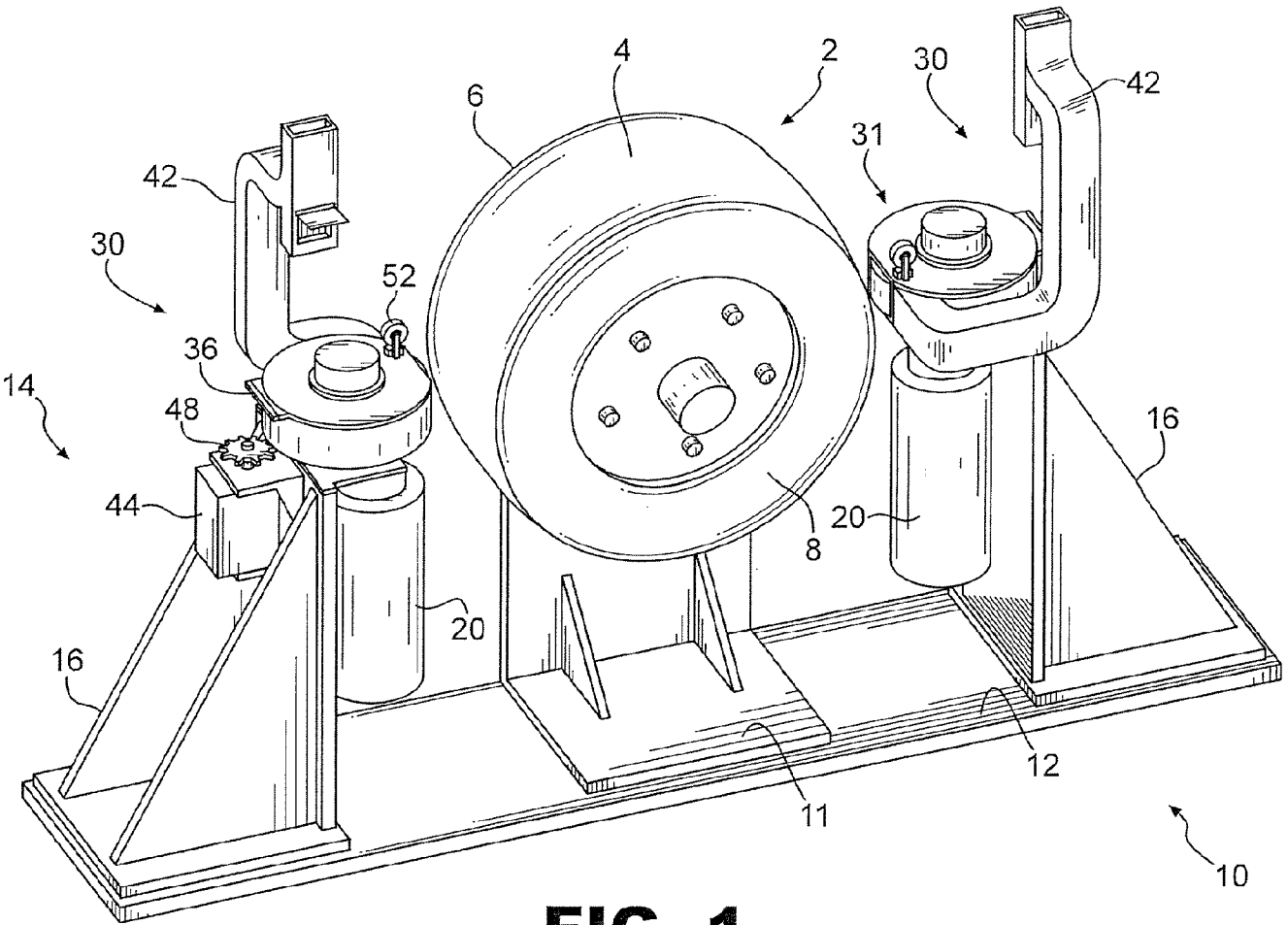
FIG. 1 is a perspective view of a dual head buffing ("tire buffing") machine according to an embodiment of the present invention.
Figure 2:
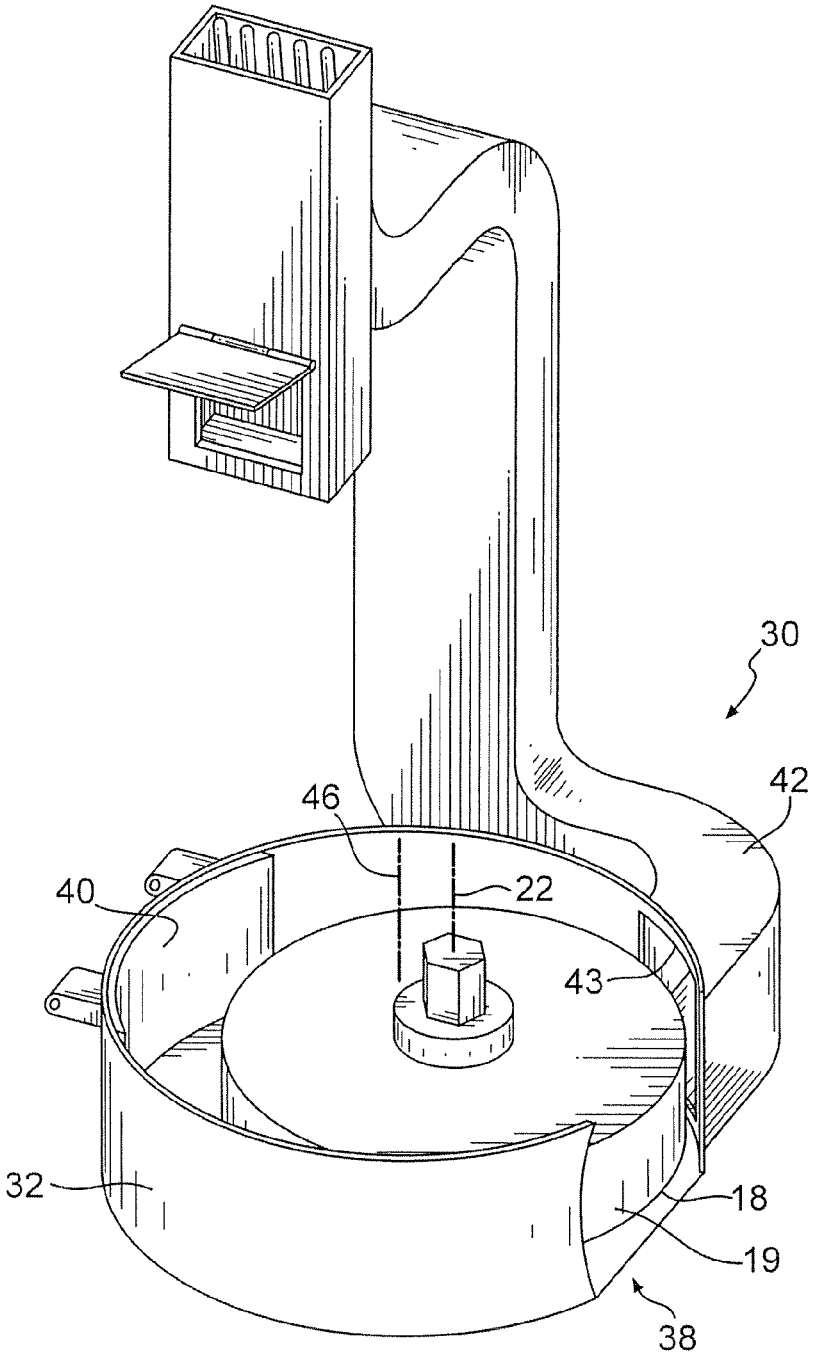
FIG. 2 is a front perspective view of a shroud of the machine identified in FIG. 1 with a portion of the safety cover removed.
Figure 3:
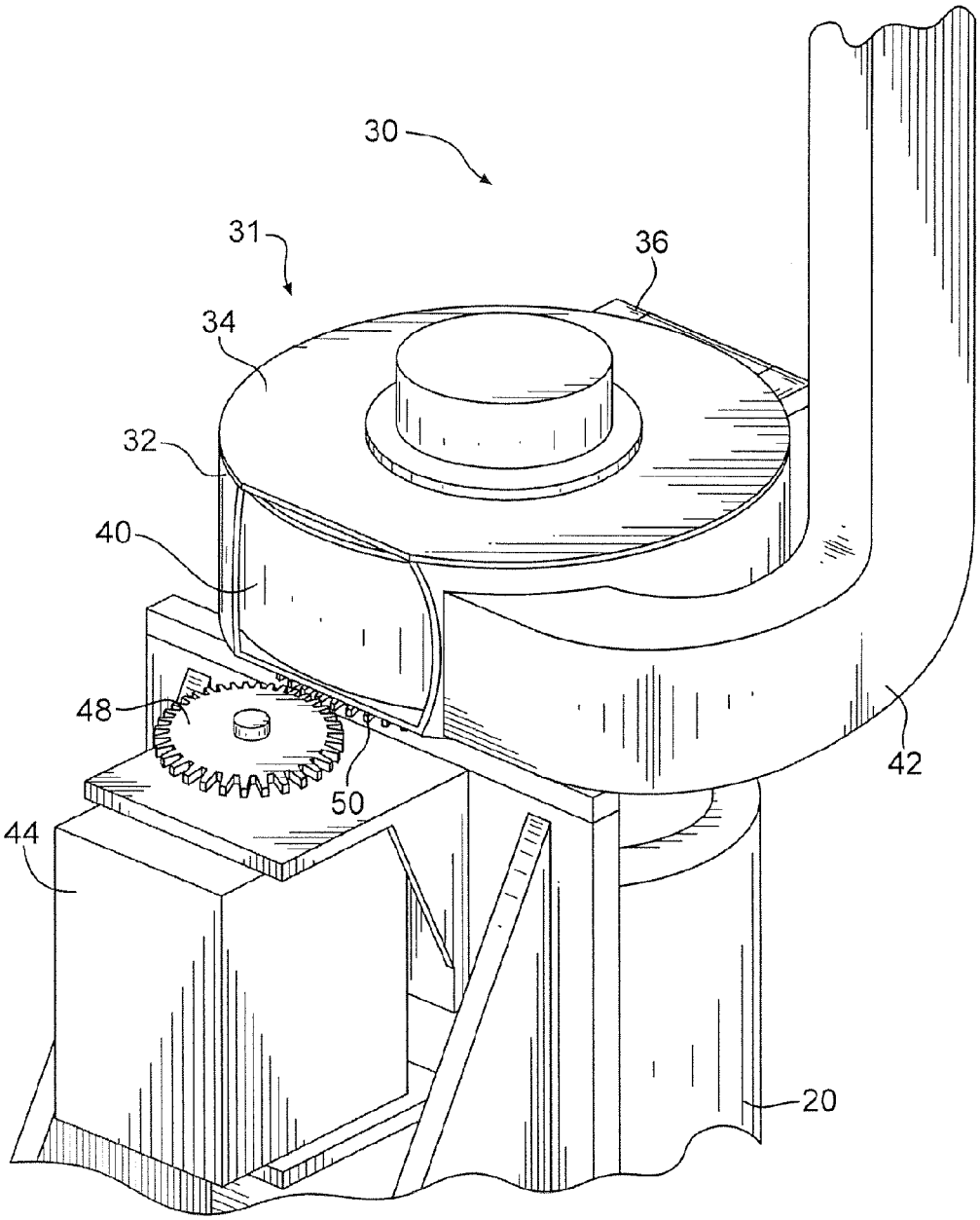
FIG. 3 is a rear perspective view of a shroud of the machine identified in FIG. 1 showing the shroud in a safety position.

Particular embodiments of the present invention provide apparatus and methods for collecting debris generated while buffing a tire casing on a tire buffing machine. Such buffing of the tire removes an old tread from a tire casing to prepare the tire casing for a retreading operation. According to particular embodiments, the apparatus and methods provide a debris collection system having a shroud that rotates as the cutting head, which is the tread removal tool, translates across the tread of a tire. The shroud rotates to better align the collection portion of the system with a projected path of material being discharged from the cutting head cutting surface.

With reference to FIGS. 1-5, an exemplary example of the present invention is disclosed as a tire buffing machine 10 having a debris collection system. The buffing machine 10 includes two buffing units 14 operably mounted to a base 12 and a mounting unit 11 for mounting a tire 2. Each buffing unit 14 translates along the base 12 to buff the tire 2 as desired. Further, the mounting unit 11 and/or the buffing units 14 may rotate (e.g., pivot) in relation to the other during the buffing process so that the buffing unit 14 buff a desired width of the tire 2, including the tread 4. By utilizing a servo, sensors, and the like, in conjunction with a controller 60, the buffing machine 10 is able to determine and control the location and movement of the tire 2 with respect to each buffing unit 14, while each translates and/or rotates with respect to the other. The controller 60 may also be used to control other aspects of the buffing machine 10, including the rotation of the cutting head 18 and the rotation of shroud 30, each of which is discussed in more detail below. It is contemplated that the tire 2 may be mounted on a mounting unit 11 that is separate from the buffing machine 10.

The controller 60 includes a logic processor 61, which may be a microprocessor, a memory storage device 62, such as RAM (random access memory), ROM (read-only memory), PROM (programmable read-only memory), and at least one input/output (I/O) cable 66 for communicating with the buffing machine 10. Further, the controller may include an I/O slot 63 for housing an I/O card having an I/O cable connector 64.

An operator may utilize a user-interface 68 to monitor the buffing of the tire 2 and to program or otherwise control or instruct the operation of the controller 60 and the buffing machine 10, which includes performing each step and method in accordance with this invention. The user-interface 68 and the controller 60 may communicate by way of an I/O cable 67. It is also contemplated that wireless communications may exist between the controller 60, the user-interface 68, and the buffing machine 10.

The controller 60 may be programmed by any known graphical or text language. Programmed instructions, data, input, and output may be stored in a memory storage device 62, which is accessible to the processor 61. The memory storage device 62 also stores inputs, outputs, and other information, such as, for example, profiles of treads, for use by the processor 61 in performing its operations. The memory device 62 may comprise any commercially known storage device, such as such as hard disk drives, optical storage devices, flash memory, and the like. The processor 61 executes programmed instructions and may perform the distance and/or positional calculations and measurements, as wells as other operations, discussed herein.

Each buffing unit 14 generally comprises a cutting head 18, a cutting head motor 20, a shroud 30, and a shroud driver 44. The components are generally mounted to a frame 16 for translation and/or rotation. The cutting head 18 includes a cutting head cutting surface 19 for buffing the tread 4 from the tire 2. The cutting head 18 generally represents any tread removal tool, such as without limitation rasps, grinding wheels, and wire brushes. The rasp motor 20 rotates the cutting head 18 about a cutting head axis 22 in a clockwise and/or a counterclockwise direction.

The shroud 30 includes a cover 31, which may comprise a side cover 32 and a lid 34, a hinge 36, a cutting head access window 38, a guard plate 40, and a vacuum suction port 43. The cover 31 substantially contains the cutting head 18, and therefore, it is contemplated that the cover 31 may comprise any design capable of substantially covering the cutting head 18, whether or not such design uses a side cover 32 and lid 34 as disclosed herein. Between the lid 34 and the side cover 32, a hinge 36 may exist.

Within the side cover 32 is a cutting head access window 38, which provides the cutting head 18 access to engage the tire 2. When the cutting head 18 is not engaging the tire 2, the shroud 30 may rotate into a guarded position, where a guard plate 40 operates to substantially cover the cutting head access window 38. To achieve this, it is contemplated that either the cover 31 or the guard plate 40 may rotate to align the cutting head access window 38 with the guard plate 40.

To collect and discharge the debris removed from the tire by the cutting head 18, a vacuum suction ductwork 42 is operably attached to the vacuum suction port 43 of the cover 31 (or side cover 32). In one embodiment, the vacuum port 43 is positioned adjacent to the cutting head access window 38. More specifically, the vacuum suction port 43 is positioned to collect debris discharged from the cutting head 18 as it buffs the tire 2, which is the side toward which the cutting head 18 rotates during engagement with the tire 2. For example, in FIG. 2, the cutting head 18 is rotating across the cutting head access window 38 towards the vacuum port 43 (i.e., counterclockwise about the cutting head axis 22—from a top view perspective), which discharges the debris abraded from the tire 2 towards the vacuum port 43.

The vacuum port 43 may include vacuum suction air flow to assist in the collection and removal of discharged material. Further, the opening and/or the ductwork 43 of the vacuum port 43 may be constricted or expanded to increase or decrease, respectively, the internal air velocity. Although not necessary, the air velocity may be equal to or greater than the velocity of the cutting head 18, or the debris being discharged from the cutting head 18.

Figure 7:
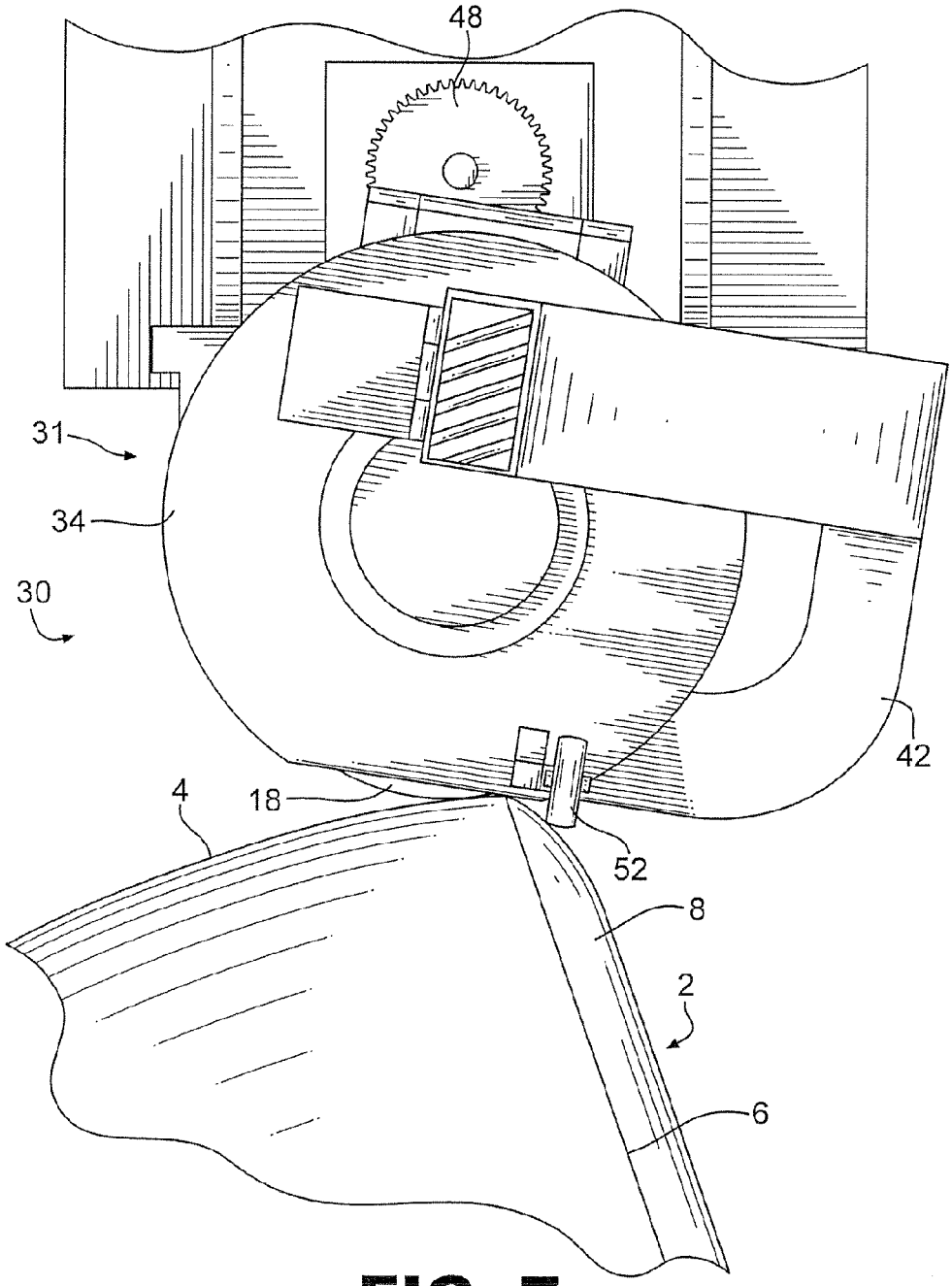
FIG. 7 is a top view of the buffing machine identified in FIG. 1 engaging a tire tread near a shoulder of the tire, in accordance with the present invention.
Figure 8:
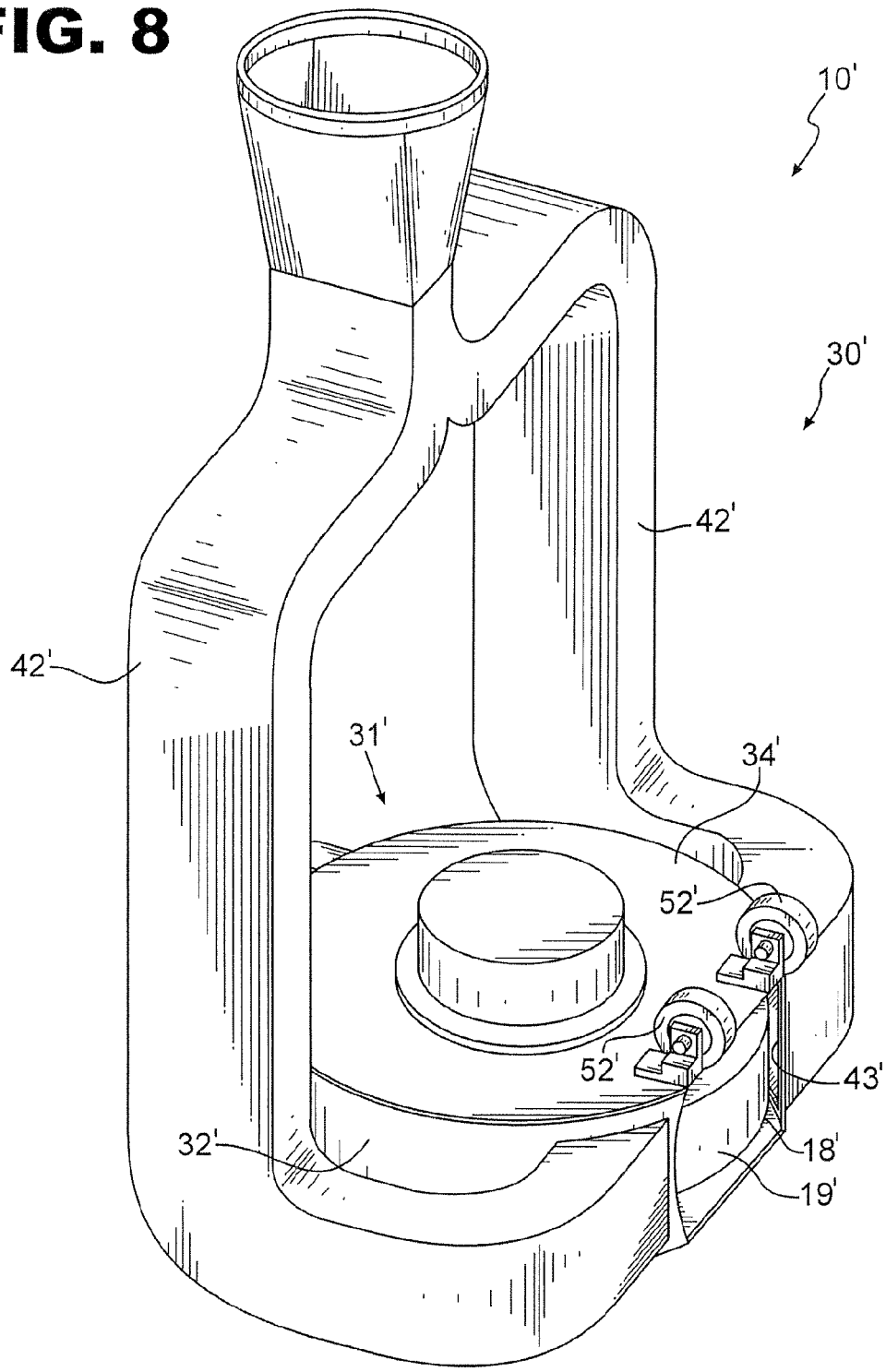
FIG. 8 is a perspective view of a single-head buffing head of a tire buffing machine according to an embodiment of the present invention.

In other embodiments, as shown in FIG. 8, the buffing machine 10' may include a buffing unit 14' having a cutting head motor 20 that rotates the cutting head 18' in both clockwise and counterclockwise directions. Accordingly, the buffing unit 14' is capable of buffing the tire tread 4 in both lateral (i.e., axial) directions across the tread 4. Therefore, two vacuum ports 42' may exist—each located on opposite sides of the cutting head access window 38 to collect debris discharged from the cutting head 18' rotating in one of the two directions. This embodiment differs from the buffing unit 14 shown in FIGS. 1-7, which generally buffs in one direction across the tread 4.

The shroud driver 44 provides rotational capabilities to the shroud 30. In particular embodiments, a drive gear 48 extends from the shroud driver 44 to engage a shroud gear 50. The shroud gear 50 is operably attached to the shroud 30 to cause the shroud 30 to rotate about the shroud axis 46. In one embodiment, the cutting head axis 22 and shroud axis 46 are parallel to each other; however, it is contemplated that the axes 22, 46 may be skewed with respect to each other or may comprise the same axis.

In particular embodiments, the shroud driver 44 may comprise any linear or rotational motor or drive, including, without limitation, an electric motor, an air motor, a servo, a stepper motor, an actuator, a cylinder, or the like. In particular embodiments, the shroud driver 44 is a motor that provides a constant torque or force for rotating the shroud 30. It is contemplated that other means known to one skilled in the art may be used in lieu of gears 48, 50 to transfer force from driver 44 to rotate shroud 30, including, without limitation, friction plates, chains, and linkages.

To control the rotation of shroud 30, a guide 52 may be attached to the shroud 30 or otherwise extend therefrom to engage the tire 2 when the buffing head is buffing the tire. The guide 52 generally extends from the shroud 30 near the cutting head access window 38 on the side of vacuum port 43 (i.e., the side of debris discharge). The guide 52 operates to limit the rotation of the shroud 30, while maintaining a clearance distance between the shroud 30 and tire 2.

The guide 52 may comprise a roller, a wheel, a bar or any other device known to one skilled in the art that does not interfere with the rotation of the tire 2 or the movement of the buffing head 18 during the buffing process. For example, it is contemplated that the guide 52 may comprise dual or multiple rollers or a single roller having an increased width. The increased width advantageously increases the contact patch of the guide on the tire 2, thereby reducing the rolling resistance or binding associated with a small contact patch as the guide 52 travels across the tread 4 during a buffing operation. For example, a guide 52 having a small contact patch may become entangled in a tread or gouge in the tire tread, thereby interfering with the rotation of the tire 2 or movement of the buffing head 18 during the buffing process.

Figure 4:
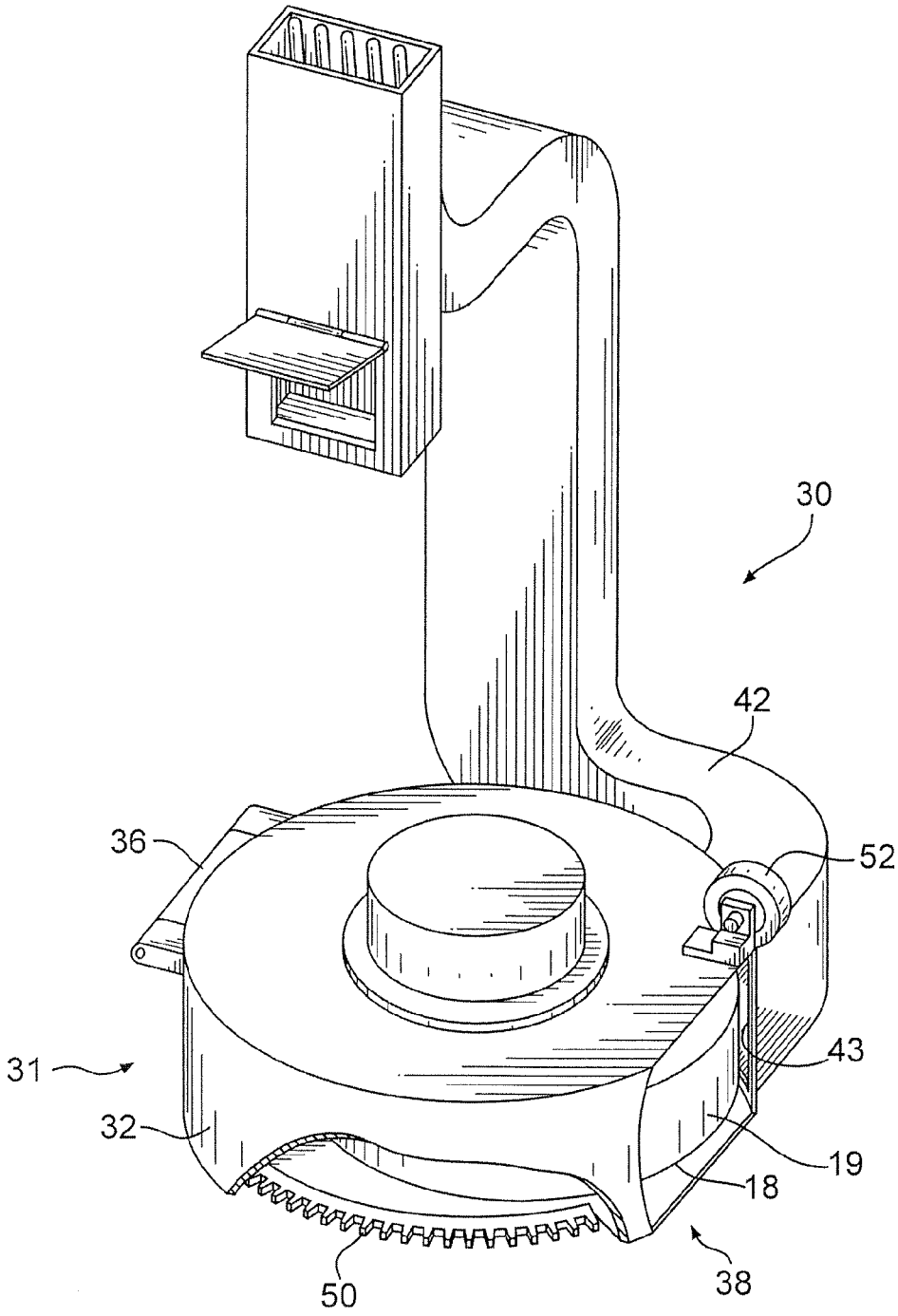
FIG. 4 is a front perspective view of a shroud of the machine identified in FIG. 1 showing a cutaway portion of the shroud.
Figure 5:
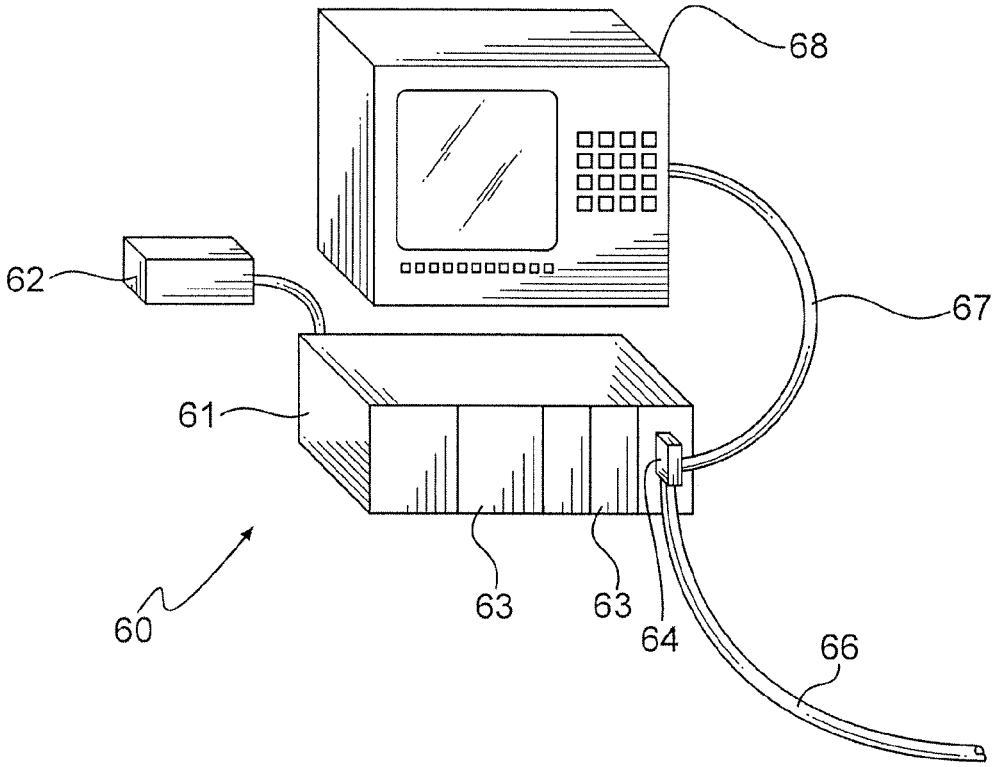
FIG. 5 is a perspective view of a processing unit of the machine identified in FIG. 1.

Optionally, for example, the guide 52 may comprise a bar across the cutting head access window 38, extending to the same extent beyond the cutting head access window 38 as the rollers 52 shown, for example, in FIG. 4 or 8. It is also contemplated that the guide 52 may freely pivot, or otherwise be fixed at an angle relative to the tire's direction of rotation about the axle of the mounting unit 11, while the tire 2 is being buffed to help reduce the resistance exhibited upon the guide 52 as it travels across the tread 4 during a tire buffing operation.

Figure 6:
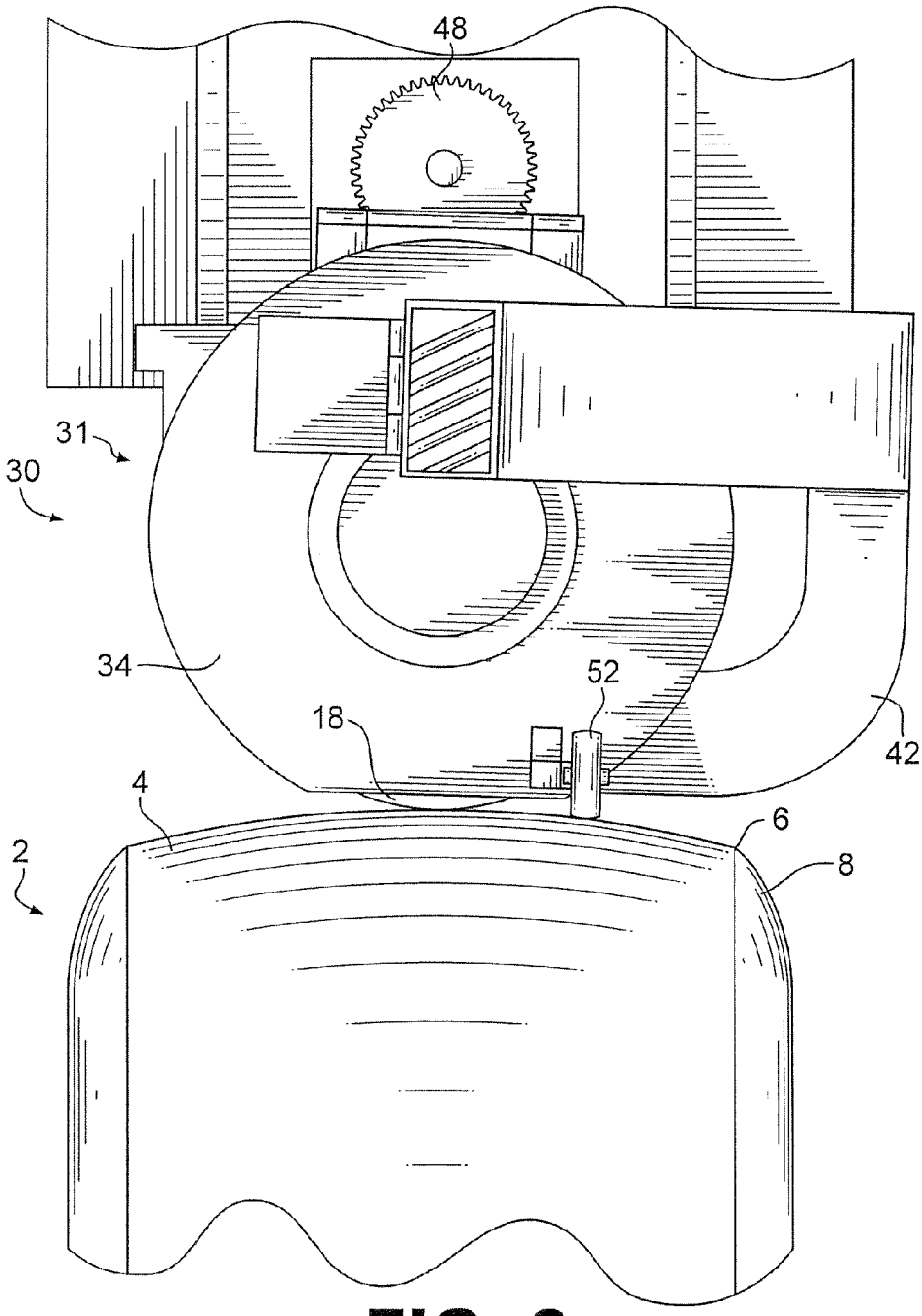
FIG. 6 is a top view of the buffing machine identified in FIG. 1 engaging a tire along a central portion of the tread, in accordance with the present invention.

In operation, and with specific reference to FIGS. 6-7, the shroud driver 44 applies a rotational force to the shroud gear 50 via the drive gear 48. The rotational force is thereby transferred to the guide 52, which forces the guide 52 against tire 2 during the buffing process. As the cutting head 18 translates across the width of the tire tread, the rotational force generated by the shroud driver 44 forces the guide 52 to follow the curvature of the tire tread surface. As a consequence of the guide 52 being forced to follow the tread curvature, the shroud 30 rotates, thereby maintaining the cutting head access window 38 and vacuum port 43 in a position better aligned with the path of debris being discharged from the cutting head 18.

If the shroud 30 did not rotate as needed during the buffing operation, the gap between the discharge side of the cutting head access window 38 and the tire 2 would grow as the cutting head 18 approached the tire shoulder 6 (i.e., the side of the tire). Upon reaching the tire shoulder 6, the guide 52 may translate about and down the shoulder 6 and even along sidewall 8 of tire 2. This causes the shroud 30 to rotate further about the shoulder 6 and thereby better align the vacuum port 43 with the discharge path of the debris being discharged from the cutting head 18.

In alternative particular embodiments, an example of which is shown in FIG. 8, a buffing machine 10' includes a second guide 52' since the buffing unit 14' buffs in both lateral directions across the tread 4 (as described above).

It is also contemplated that proximity sensors or switches, or the like, may be used to properly control the rotation of the shroud 30 or the guard plate 40 between a guarded position and a buffing position.

In other particular embodiments, the rotation of the shroud 30 may be controlled without a guide 52 when the shroud driver 44 is a positional control device, such as, without limitation, a servo, a stepper motor, and the like. The positional control device may provide linear or rotational output, and may operate by way of an electric motor, or otherwise utilize hydraulics, pneumatics, or magnets. Further, the control device may include a positional feedback device or may use a controller 60 (such as, for example, a PLC or other digital or analogue control known to those having ordinary skill in the art) to control the movement and position of the shroud 30.

In particular embodiments, the positional control driver 44 rotates the shroud 30 in relation to the tread profile or shape as the cutting head 18 translates across the tread 4. It is contemplated that the actual or estimated tread profile or shape may be input into a controller or selected from a plurality of profiles stored in the controller memory (such as memory storage device 62). Further, it is contemplated that the buffing machine 10 may instead monitor the tread location and/or tread profile or shape to determine how and when to rotate the shroud 30 to better align the vacuum port 43 with the flow of debris being discharged from the cutting head 18. Knowing the width of the cutting head access window 38 may be useful in determining the rotational position of the shroud 30 and the amount of rotation necessary to adjust the shroud 30 as the cutting head 18 translates across tread width. It is contemplated this embodiment may also include a proximity sensor to monitor the gap between the shroud 30 and the tire 2.

Particular embodiments of the present invention further include methods for collecting debris generated while buffing a tire casing on a tire buffing machine, such machines having been discussed above. Such methods may include the steps of translating the cutting head of the buffing machine across a tire to a subsequent location and rotating a shroud about a shroud axis to obtain an alignment of a vacuum suction port of the shroud with a projected path of debris discharged from the cutting head cutting surface. Such methods may further include the step of collecting the debris through the vacuum suction port.

Particular embodiments of such methods include, for example a shroud that comprises a side member surrounding a majority of the cutting head cutting surface, a cutting access window to expose the cutting head cutting surface for buffing the tire casing, and a vacuum suction port adjacent to the cutting access window.

Particular embodiment of the present invention may further include the step of controlling rotation of the shroud to maintain the alignment of the vacuum suction port with the projected path of debris discharged from the cutting head cutting surface. The method may further include the step of rotating the shroud about a shoulder of the tire.

The step of controlling rotation of the shroud to maintain the alignment may comprise, in particular embodiments, the step of causing the rotation of the shroud by a servo, a controller, a guide or combinations thereof, wherein the guide extends from the shroud to contact the tire during buffing. In particular embodiments, the method may further include the step of applying a constant force by the driver for rotating the shroud during buffing. Such a step provides that the guide is pressed against the tire surface during the buffing operation, thereby providing an alignment between the vacuum suction port and the projected path of the debris discharged from the cutting head cutting surface.

Particular embodiments of the present invention may further include the step of rotating the shroud between a guarded position and a buffing position, the cutting head access window being covered by a guard plate when in the guarded position.

While this invention has been described with reference to particular embodiments thereof, it shall be understood that such description is by way of illustration and not by way of limitation. Accordingly, the scope and content of the invention are to be defined only by the terms of the appended claims.

What is claimed is:

1. A debris collection system for collecting debris generated while buffing a tire casing on a tire buffing machine, the tire buffing machine having a cutting head rotatable about a cutting head axis, the system comprising:

a rotatable shroud being rotatable about a shroud axis, the shroud comprising a side member surrounding a majority of a cutting head cutting surface, a cutting head access window to expose the cutting head cutting surface for buffing the tire casing, and a vacuum suction port adjacent to the cutting head access window; and, a shroud driver to rotate the shroud during buffing, wherein rotating the shroud during buffing aligns the vacuum suction port with a projected path of debris discharged from the cutting head cutting surface.

2. The debris collection system of claim 1, the shroud further comprising:

a guide extending from the shroud and situated to contact the tire during buffing for controlling the rotation of the shroud.

3. The debris collection system of claim 2, wherein the guide is situated to contact the tire between a buffing point and the vacuum suction port.

4. The debris collection system of claim 2, wherein the shroud driver supplies a constant force for rotating the shroud.

5. The debris collection system of claim 1, further comprising:

a controller for controlling the position of the shroud rotating about the shroud axis.

6. The debris collection system of claim 1, wherein the cutting head axis is parallel to the shroud axis.

7. The debris collection system of claim 1 further comprising:

a first gear operably attached to the driver; and a second gear operably attached to the shroud and in mating contact with the first gear.

8. The debris collection system of claim 7, wherein the second gear has a discontinuity about its circumference, the discontinuity located adjacent the access window when the cutting head is in a tire engagement position.

9. The debris collection system as of claim 1, the shroud being rotatable between a guarded position and a buffing position.

10. The debris collection system of claim 9, further comprising:

a safety plate for covering the access window when the shroud is in the guarded position.

11. The debris collection system of claim 1, further comprising:

a second vacuum suction port located adjacent to the cutting access window and opposite the other vacuum suction port, wherein the driver operates in a clockwise and a counterclockwise direction.

12. A tire buffing machine, comprising:

a cutting head having a cutting surface rotatable about a cutting head access; and the debris collection system of claim 1.

13. The debris collection system of claim 1, wherein the shroud is rotatable about the cutting head for altering the position of the cutting head access window relative to the cutting head.

14. The debris collection system of claim 1, wherein the shroud is rotatable about a lateral curvature of the tire casing.

15. A method for collecting debris generated while buffing a tire casing on a tire buffing machine, the tire buffing machine having a cutting head rotatable about a cutting head axis, the method comprising the steps of:

translating the cutting head across a tire to a subsequent location;

rotating a shroud about a shroud axis to obtain an alignment of a vacuum suction port of the shroud with a projected path of debris discharged from a cutting head cutting surface, wherein the shroud comprises a side member surrounding a majority of the cutting head cutting surface, a cutting access window to expose the cutting head cutting surface for buffing the tire casing, a vacuum suction port adjacent to the cutting access window and a shroud driver to rotate the shroud during buffing; and, collecting the debris through the vacuum suction port.

16. The method for collecting debris of claim 15, further comprising:

controlling rotation of the shroud to maintain the alignment of the vacuum suction port with the projected path of debris discharged from the cutting head cutting surface.

17. The method for collecting debris of claim 16, wherein the step of controlling rotation of the shroud to maintain the alignment comprises:

rotating the shroud about a shoulder of the tire.

18. The method for collecting debris of claim 16, wherein the step of controlling rotation of the shroud to maintain the alignment comprises:

causing the rotation of the shroud by a servo, a controller, a guide or combinations thereof, wherein the guide extends from the shroud to contact the tire during buffing.

19. The method for collecting debris of claim 18, further comprising:

applying a constant force by the shroud driver for rotating the shroud during buffing.

20. The method for collecting debris of claim 15, further comprising:

rotating the shroud between a guarded position and a buffing position, the cutting head access window being covered by a guard plate when in the guarded position.

21. The method for collecting debris of claim 15, wherein the step of rotating the shroud includes rotating the shroud about the cutting head to alter the position of the cutting head access window relative to the cutting head.

22. The method for collecting debris of claim 15, wherein the step of rotating the shroud includes rotating the shroud about a lateral curvature of the tire casing.

* * * * *